United States Patent [19]

Jensen

[11] Patent Number: 4,867,443

[45] Date of Patent: Sep. 19, 1989

[54] CROSS-COUNTRY SKIING SIMULATOR

[75] Inventor: Hans C. Jensen, Vancouver, Canada

[73] Assignee: Altero Technologies, Inc., Richmond, Canada

[21] Appl. No.: 168,880

[22] Filed: Mar. 16, 1988

[51] Int. Cl.[4] ..... A63B 21/00; A63B 1/00

[52] U.S. Cl. ..... 272/97; 272/70; 434/253

[58] Field of Search ..... 272/97, 70, 128, 131, 272/132, 133, 73; 434/253, 255; 128/25 R, 25 B

[56] References Cited

U.S. PATENT DOCUMENTS

| | | | |
|---|---|---|---|
| 3,966,201 | 6/1976 | Mester | 272/132 |
| 4,023,795 | 5/1977 | Pauls | 272/97 |
| 4,434,981 | 3/1984 | Norton | 272/97 |
| 4,645,201 | 2/1987 | Evans | 272/97 |
| 4,679,786 | 7/1987 | Rodgers | 272/70 |

FOREIGN PATENT DOCUMENTS

| | | | |
|---|---|---|---|
| 2631897 | 1/1978 | Fed. Rep. of Germany | 272/97 |

*Primary Examiner*—S. R. Crow

*Attorney, Agent, or Firm*—Flehr, Hohbach, Test, Albritton & Herbert

[57] ABSTRACT

An exercise machine for simulating cross-country skiing is disclosed in which the poling action of the arms and the leg action both drive the same flywheel through a system of overrunning clutches. This provides a more realistic simulation of cross-country skiing than the prior art devices in which the arm motion was independent of the leg action.

10 Claims, 2 Drawing Sheets

CROSS-COUNTRY SKIING SIMULATOR

BACKGROUND OF THE INVENTION

The invention relates to exercise apparatus which simulate cross-country skiing.

Various apparatus have been designed to permit cross-country skiers to exercise the muscles necessary for the sport in a stationary location indoors in a gymnasium or the like The purpose of such apparatus is to simulate as closely as possible the movements involved in actual cross-country skiing In the past, such devices have typically included a pair of foot plates mounted on a pair of tracks extending along a base frame. The foot plates connect to endless belts which in turn drive a flywheel. See for example U.S. Pat. No. 4,659,077 issued Apr. 21, 1987 to Fitness Quest Inc., U.S. Pat. No. 4,645,201 issued Feb. 24, 1987 to Tekron Licencing B.V., U.S. Pat. No. 4,434,981 issued Mar. 6, 1984 to Desmond Norton, U.S. Pat. No. 4,023,795 issued May 17, 1977 to Edward Pauls, U.S. Pat. No. 3,941,377 issued Mar. 2, 1976 to Hakon Lye, and the product currently sold under the trademark NORDIC TRACK.

In order to provide simultaneous exercise for the arms through poling motion, such devices have typically had a separate pulley or spring system for each arm which operates independently of the leg motion. The problem with such apparatus is that they do not adequately simulate the sensation of cross-country skiing. In actual cross-country skiing, the energy transmitted through the ski poles creates a gliding sensation which in turn affects the way in which force is transmitted through the leg action. In the prior art devices, however, the amount of exertion applied to the poling action has no effect on the resistance presented to the leg motion. Consequently, the user does not receive the same sensation as actual cross-country skiing and the amount of exercise which the various muscles receive will likely differ from actual skiing. For example, in actual cross-country skiing, the skier may "double pole" for a period of time to build up his momentum. Once he recommences his leg motion, he will already be gliding with some momentum However, in the prior art exercise apparatus, the double-poling motion would not generate any momentum in the flywheel which is driven by the leg motion of the person exercising.

The present invention provides an exercise apparatus for simulating cross-country skiing in which both the poling action and leg action transmit energy to a single flywheel so that the user receives a more realistic simulation of cross-country skiing.

SUMMARY OF THE INVENTION

The present invention provides an exercise apparatus for simulating cross-country skiing which comprises a pair of foot plates running in parallel tracks, each attached to an endless belt, and a pair of sliding plates attached to the tips of two ski poles running in parallel tracks on either side of the foot plate tracks, with each of the pole plates also attached to an endless belt. Each of the four endless belts drives a common drive shaft through overrunning clutches A flywheel is connected to the drive shaft and means may be provided for adjusting the resistance applied to the flywheel.

BRIEF DESCRIPTION OF THE DRAWINGS

In drawings which illustrate a preferred embodiment of the invention.

DETAILED DESCRIPTION OF A PREFERRED EMBODIMENT

Figure 1:
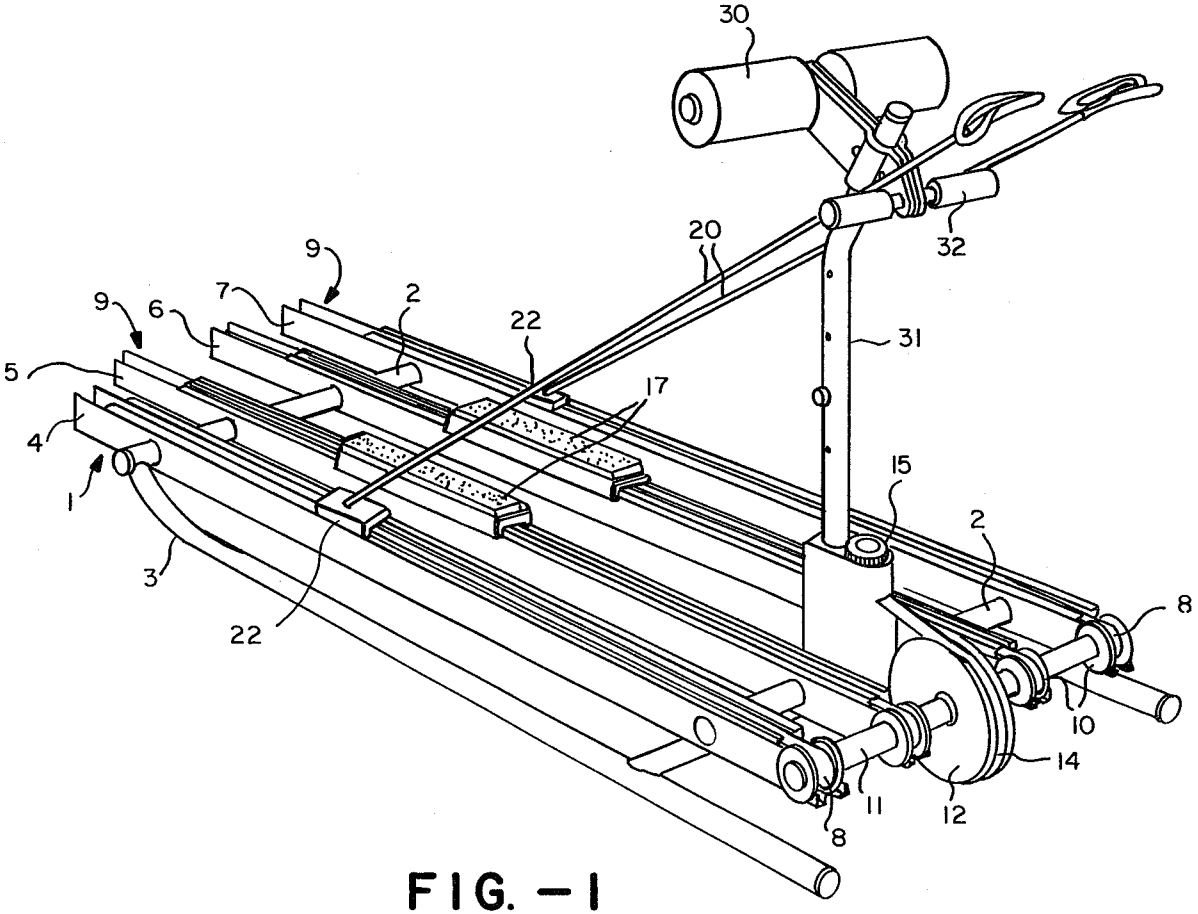
FIG. 1 is a perspective view of the exercise apparatus of the invention.

Referring to FIG. 1, the exercise apparatus of the invention is designated generally as 1. The device has a base 3 which supports four parallel tracks 4, 5, 6 and 7. The four tracks are held in rigid relationship by cross bars 2 which are in turn fixed relative to base 3. Mounted within each track is an endless belt 8 which runs around a pulley 9 at the rear end of the device and a pulley 10 provided with an overrunning clutch at the front end of the device. Each overrunning clutch is mounted on drive shaft 11 so that movement of the belt 8 in the clockwise direction in FIG. 1 will cause the clutch to freewheel while movement of the belt in the counter-clockwise direction will cause drive shaft 11 to rotate. A suitable overrunning clutch is the bearing manufactured and sold under the trademark "TORRINGTON CLUTCH BEARINGS."

Mounted on drive shaft 11 is a heavy flywheel 12. Friction can be applied to flywheel 12 using a friction belt 14 in a known fashion. The tension on belt 14 can be adjusted by knob 15 which will increase or decrease the tightness of belt 14 against the flywheel and thereby allow the user to vary the resistance to motion of the endless belts.

The two central tracks 5 and 6 have mounted thereon foot plates 17 which have a high friction upper surface and are connected to belts 8. Foot plates 17 may slide on tracks 5 and 6 on rollers or on a pad of low friction material such as TEFLON. Means can be provided to oil the point of contact between the foot plates 17 and the surface of the track. Foot plates 17 can have straps to secure the user's feet or the user's feet may be secured simply by friction, by providing a high friction grit surface on the pad and possibly also by providing a slight forward slope to the plate.

Figure 2:
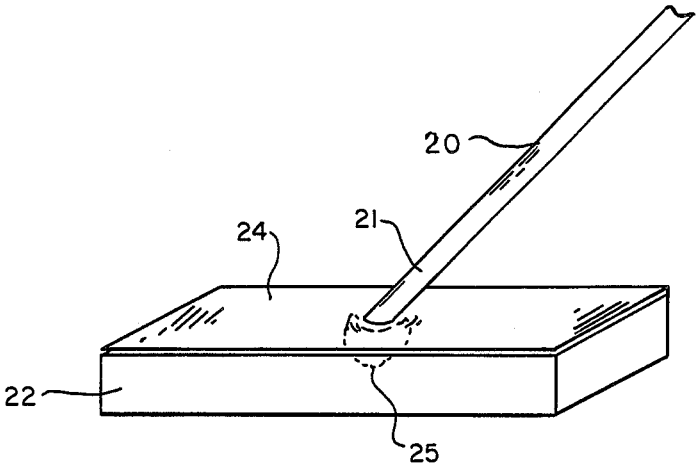
FIG. 2 is a detailed view of the pole plate of a first embodiment of the invention.
Figure 3:
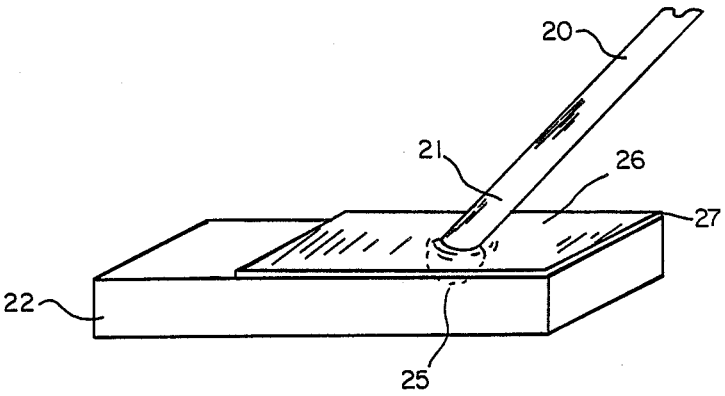
FIG. 3 is a detailed view of a second embodiment of the pole plate of the invention.

Ski poles 20 have tips 21 which are secured to ski pole plates 22. The two plates 22 are in turn fixed to endless belts 8 and slide on tracks 4 and 7 respectively, either on rollers or a surface of low-friction material. In the embodiments shown in FIG. 2, tip 21 is secured to a thick rubber sheet 24 which is secured at both ends to plate 22. In the embodiments shown in FIG. 3, tip 21 is secured to thick rubber sheet 26 which in turn is secured only at its forward end 27 to plate 22. In this way, the pole will drive the plate backwards when pressure is applied, but it is free to rotate in any direction about the end of tip 21. Tip 21 may be secured to the rubber sheet 24 or 26 by an enlarged ball 25 which is secured to the end of the tip and is forced through a hole in the rubber sheet, thereby creating a universal joint. Hip pad or bumper 30 is supported on column 31. The height of hip pad 30 is adjustable. Handles 32 are also provided for use of the machine without the poles.

To use the machine, the user adjusts the height of hip bumper 30 so that it rests against his hip at a comfortable location. The user places his feet on the two foot plates 17 and grasps the handles of ski poles 20. (If the user desires, he may simply use the leg exercise aspect of the machine and grasp handles 32 with his hands.) The user applies force in the rearward direction on the poles 20 and on the foot pads 17, using the same motions one would use in cross-country skiing, including double-poling. Due to the one-way clutches 8, rearward motion by any one or more of the pole plates 22 or foot plates 17 will cause flywheel 12 to rotate Flywheel 12 typically will have a weight of about 16 pounds and so will generate some momentum. The amount of resistance on the flywheel can be varied by tightening belt 14 using knob 15 to simulate a more difficult course. Similarly, the entire plane of the tracks 4, 5, 6 and 7 can be tilted upwardly, either by raising the front end of the apparatus or lowering the rear end, in order to simulate an uphill situation and also to remove some of the pressure against hip pad 30. The hip bumper 30 keeps the user's body stationary despite the rearwardly-directed forces It will be seen that any work done by the user will be translated into rotation of the flywheel and thus the effect of gliding is created. Various modifications of the design will be apparent to those skilled in the art. For example, nylon ropes could be substituted for the belts 8 shown in FIG. 1. However, the scope of the invention is to be defined in terms of the accompanying claims.

The invention has been described herein with reference to certain preferred embodiments. However, as obvious variations thereon will become apparent to those skilled in the art, the invention is not to be considered as limited thereto.

What is claimed is:

1. An exercise apparatus for simulating cross-country skiing, comprising:

a) a base frame having front and rear ends;

b) four parallel, substantially horizontal tracks mounted on said base frame to extend between said front and rear ends and forming an inner pair and an outer pair of tracks;

c) a drive shaft mounted for rotation adjacent said front end of said frame;

d) two pulleys associated with each track, said pulleys being mounted for rotation at separate locations adjacent opposite ends of each said track, a first pulley mounted on said drive shaft and a second pulley mounted adjacent the rear end of said frame;

e) endless belt means mounted in association with each said track for motion around said pulleys;

f) two foot-receiving plates mounted for sliding motion one on each of the two of said horizontal tracks forming the inner pair of tracks, and each secured to its respective endless belt means;

g) two pole-receiving plates mounted for sliding motion one on each of the two of said horizontal tracks forming the outer pair of tracks, and each secured to its respective endless belt means;

h) two ski poles;

i) means fixed to said pole-receiving plates and to the lower ends of said ski poles providing a pivotable connection between said pole-receiving plates and said lower pole ends;

j) one-way clutch means linking each said first pulley to said drive shaft whereby motion of said belt is freely permitted in one direction but motion of said belt means in the opposite direction drives said drive shaft; and k) a flywheel mounted on said drive shaft.

2. The exercise apparatus of claim 1 further comprising means for applying variable resistance to said flywheel.

3. The exercise apparatus of claim 1 further comprising upstanding means for contacting the body of a user of the apparatus and resisting the forward motion of said user.

4. The exercise apparatus of claim 1 wherein said means for fixing said ski pole tips lower pole ends to said pole-receiving plates comprises a sheet of elastomeric material provided with an aperture for receiving said ski pole tip lower pole end.

5. The exercises apparatus of claim 1 wherein said pivotable connection is a universal connection.

6. An exercise apparatus for simulating cross-country skiing, comprising:

(a) a base frame having front and rear ends;

(b) four parallel, substantially horizontal tracks mounted on said base frame to extend between said front and rear ends and forming an inner pair and an outer pair of tracks;

(c) a drive shaft mounted for rotation in said frame;

(d) two pulleys associated with each track, said pulleys being mounted for rotation at separate locations, one of said pulleys mounted on said drive shaft;

(e) endless belt means mounted in association with each said track for motion around said pulleys;

(f) two foot-receiving plates mounted for sliding motion one on each of the two of said horizontal tracks forming the inner pair of tracks, and each secured to its respective endless belt means;

(g) two pole-receiving plates mounted for sliding motion one on each of the two of said horizontal tracks forming the outer pair of tracks, and each secured to its respective endless belt means;

h) two ski poles;

i) means fixed to said pole-receiving plates and to the lower ends of said ski poles providing a pivotable connection between said pole-receiving plates and said lower pole ends;

j) one-way clutch means linking each said first pulley to said drive shaft whereby motion of said belt means is freely permitted in one direction but motion of said belt means in the opposite direction drives said shaft; and k) a flywheel mounted on said drive shaft.

7. The exercise apparatus of claim 6 further comprising means for applying variable resistance to said flywheel.

8. The exercises apparatus of claim 6 further comprising upstanding means for contacting the body of a user of the apparatus and resisting the forward motion of said user.

9. The exercises apparatus of claim 6 wherein said means for fixing said lower pole ends to said pole-receiving plates comprises a sheet of elastomeric material provided with an apparatus for receiving said lower pole end.

10. The exercises apparatus of claim 6 wherein said pivotable connection is a universal connection.

* * * * *

UNITED STATES PATENT AND TRADEMARK OFFICE

CERTIFICATE OF CORRECTION

PATENT NO. : 4,867,443

DATED : September 19, 1989

INVENTOR(S) : Jensen, Hans C.

It is certified that error appears in the above-identified patent and that said Letters Patent are hereby corrected as shown below:

Column 4, line 62, delete "apparatus" and insert

---aperture---.

Signed and Sealed this

Eighteenth Day of September, 1990

*Attest:*

HARRY F. MANBECK, JR.

*Attesting Officer*

*Commissioner of Patents and Trademarks*